United States Patent [19]

Reynolds

[11] Patent Number: 4,671,032

[45] Date of Patent: Jun. 9, 1987

[54] THERMALLY INSULATING STRUCTURAL PANEL WITH LOAD-BEARING SKIN

[75] Inventor: William A. Reynolds, 3617 Strawberry Rd., Anchorage, Ak. 99502

[73] Assignees: Philip W. Reynolds; Kent M. Reynolds, both of Anchorage, Ak.

[21] Appl. No.: 846,249

[22] Filed: Mar. 31, 1986

[51] Int. Cl.[4] ..... E06B 1/04; E04B 1/60; E04B 2/82; E04B 1/00

[52] U.S. Cl. ..... 52/210; 52/221; 52/309.9; 52/404; 52/807; 52/127.6; 52/127.11

[58] Field of Search ..... 52/404, 407, 807–809, 52/729, 730, 210, 127.6, 127.7, 127.8, 127.9, 127.11, 220, 221, 309.9

[56] References Cited

U.S. PATENT DOCUMENTS

| | | | |
|---|---|---|---|
| 2,116,020 | 5/1938 | Gauvin | 52/807 |
| 2,256,375 | 9/1941 | Bonsall | 52/404 |
| 3,258,889 | 5/1966 | Butcher | 52/309.9 |
| 3,885,351 | 5/1975 | Imperial et al. | 52/829 |
| 4,147,004 | 4/1979 | Day et al. | 52/309.9 |
| 4,224,774 | 9/1980 | Peterson | 52/404 |
| 4,285,184 | 8/1981 | Turner, Jr. | 52/210 |
| 4,395,853 | 8/1983 | LeMaitre | 52/309.11 |
| 4,443,988 | 4/1984 | Coutu, Sr. | 52/304.9 |
| 4,471,591 | 9/1984 | Jamison | 52/309.9 |
| 4,578,909 | 4/1986 | Henley et al. | 52/730 |

FOREIGN PATENT DOCUMENTS 2725845 12/1978 Fed. Rep. of Germany ..... 52/729

OTHER PUBLICATIONS

Applicant's Letter of Oct. 5, 1970 to Department of Housing and Urban Development, including two pages entitled "Narrative Description" and Department of Housing and Urban Development Letter ADM/CM dated Nov. 17, 1970 and pp. 5–7 entitled Outline Description #AK-2.

*Primary Examiner*—James L. Ridgill, Jr.

*Attorney, Agent, or Firm*—Chernoff, Vilhauer, McClung & Stenzel

[57] ABSTRACT

A stressed-skin building panel including structural strengthening members located alternately adjacent the two opposite skin members of the building panel, each of the structural strengthening members being spaced apart from the opposite skin member by a block of high-density rigid foam material, and the remainder of the space between the skin members being occupied by a foamed-in-place foam insulating material adhering to the skin members and structural strengthening members and providing a significant amount of strength and resistance to compressive stresses. The opposite skin members are spaced apart from one another and held together at the proper spacing during and after construction by a plurality of bridge members which form the only direct connection between the skin members by other than insulating foam material, so that the insulating quality of the panels is maximized.

13 Claims, 11 Drawing Figures

FIG.6
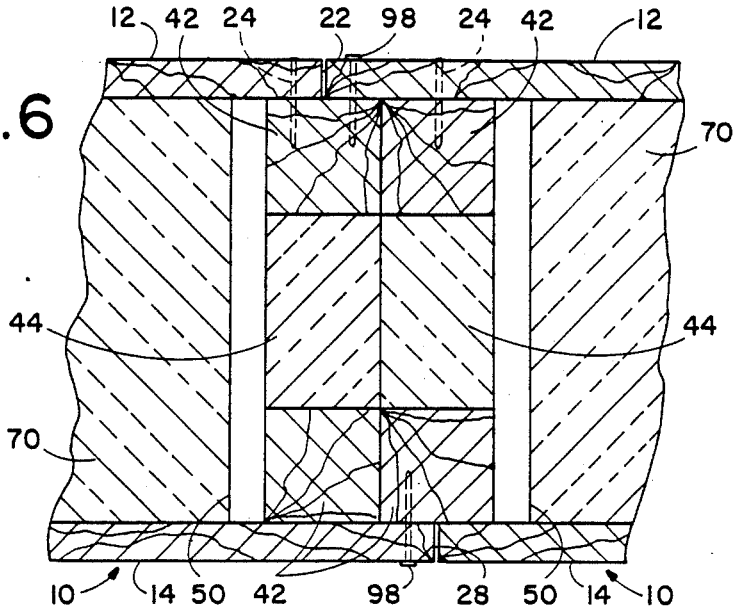
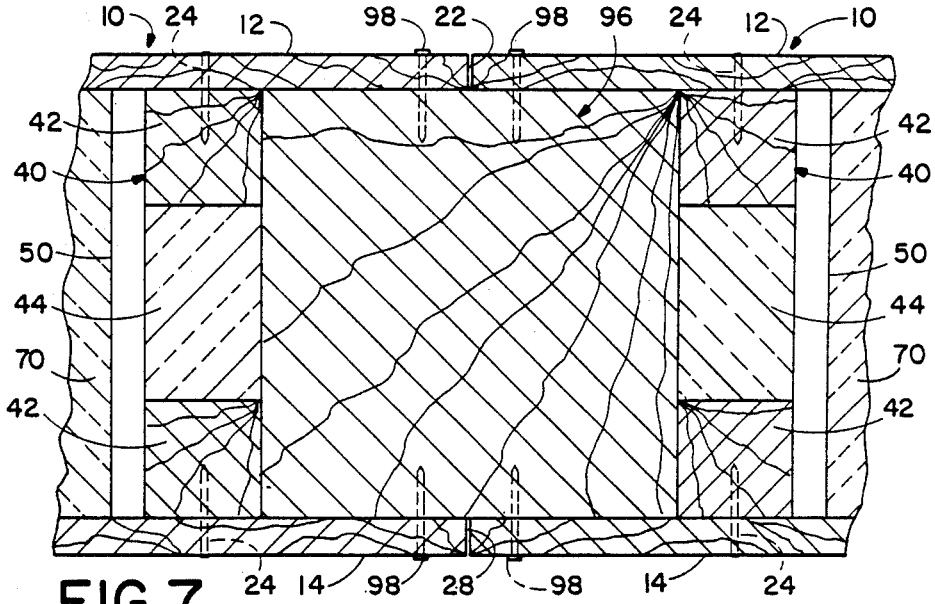
FIG.7
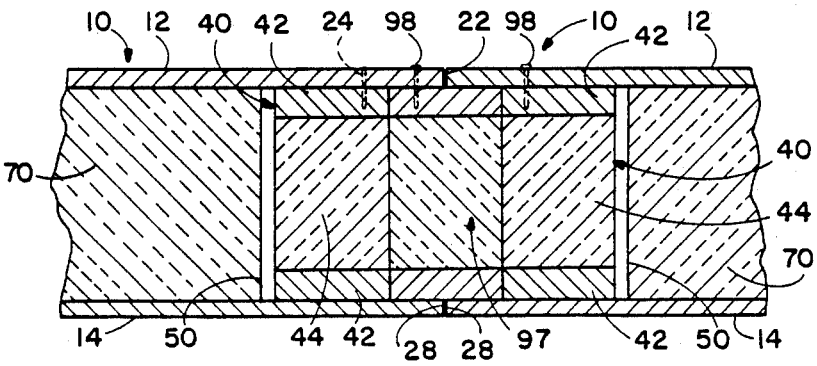
FIG. 8

THERMALLY INSULATING STRUCTURAL PANEL WITH LOAD-BEARING SKIN

BACKGROUND OF THE INVENTION

The present invention relates to structural panel assemblies, and particularly to an improved insulated structural panel incorporating a pair of oppositely located structurally reinforced load-bearing skins.

The ever-increasing cost of obtaining useful heat energy from sources such as oil, coal, wood, and the sun has caused a great deal of effort to be directed to the design of building enclosures having low thermal conductivity, for the retention or exclusion of heat. Some builders have increased wall thicknesses by using wider stud members, increasing wall thickness to measurements as great as 24 inches, in order to accommodate insulating materials such as fiberglass. Such construction is undesirably expensive, in terms of the cost of insulating materials, the amount of heat conducted through building wall stud members, and the labor used to build an enclosure having sufficient structural strength and insulation. In addition, such large cavities filled with loose insulating material in floors, walls, ceilings, and roof spaces create concern over proper ventilation, control of fires, control of insect and rodent infestation, and control and exclusion of humidity and prevention of thermal cycling within the interior portion of the panels and air infiltration into the building through the effects of vacuum and pressures caused by wind and heated air rising and finding an outlet to the outside. Maintenance costs, particularly in the event any of the enclosed material volume becomes wet or is infested with vermin, could be sizable, and repair could be difficult to accomplish. Fires in such large cavities in floors, walls, or roofs, would be quick to spread and difficult to control, and may result in rapid impairment of the structural system of the building. Recently, building codes have required that panel skins and/or the thermal barriers must remain in place for certain periods of time depending on the particular code classification of the building.

Some builders have recently begun using post-and-beam construction combined with insulated structural panels having a pair of parallel skin members of plywood and the like, interconnected and insulated by expandable plastic foam, using the panels to close the spaces defined by the post-and-beam structures. Such panels, however, have a limited amount of aesthetic appeal in architectural designs and as interior finishing panels, and such panels make only a limited contribution to structural strength.

Other building panels in use in home construction, smaller office buildings, and cold storage structures, have frames of lumber to carry structural loads, to which are attached exterior and interior plywood panel faces, with the spaces between the panel faces being filled with various insulating materials. The opposite panel faces are, thus, interconnected by wooden load-bearing members which span the entire distance between the opposite panel faces. Building panels of such construction are able to support considerable loading and are usable as floor, wall and roof panels. Such construction, however, still permits too great an amount of heat to be conducted between panel faces through the structural strength members in such building panels.

These and other related problems have been dealt with more or less satisfactorily in the past, as is shown, for example, in Jamison U.S. Pat. No. 4,471,591, which discloses a wall assembly having studs located alternately on opposite sides of a wall, with cured foam insulation located along an exterior side skin, and conventional fiberglass batts filling the space between the foam and an interior skin. Peterson U.S. Pat. No. 4,224,774 discloses a structural column member built up of a pair of dimension lumber stud elements joined by a core of mineral fibers bonded together by a resin. This structural member is used to support the inner and outer face coverings of a wall or the like, with apparently fibrous insulating material filling the remainder of the interior of the wall.

Turner, Jr. U.S. Pat. No. 4,285,184 discloses a wall construction including alternately located studs supporting the opposite skins of the wall, with the space between the skins being filled with an unspecified thermal insulating material. Coutu, Sr. U.S. Pat. No. 4,443,988 and Day et al. U.S. Pat. No. 4,147,004 disclose composite wall panels including skins of wood sheet material bonded adhesively to rigid expanded foam core material. LeMaitre U.S. Pat. No. 4,395,853 discloses a roof structure including a pair of opposite metal skins spaced apart from each other by metal spacers, with thermal insulation being located between the skins.

Butcher U.S. Pat. No. 3,258,889 discloses a prefabricated building panel in which closed cell foam is used to fasten a skin to one side of a frame structure for a wall of a mobile home.

None of the above-mentioned structures, however, has fully met the need for a building panel which is acceptably strong, light, and thermally insulative, yet low in cost and able to maintain structural integrity when subjected to the stresses of a harsh climate, high winds, structural loadings and earthquake loading.

SUMMARY OF THE INVENTION

The present invention provides a composite building panel assembly providing the insulating properties of rigid foamed-in-place plastic foam core within a panel having a pair of oppositely located, stressed skin members supported by wooden strength members which span only a part of the distance separating one skin of the panel from the opposite one. The strength members are located between the two opposite skin members of the panel and attached alternately to each of them. The skin members are supported at the desired separation from one another, both during construction of the panels and during use of the panels, by a plurality of relatively small bridge elements whose size, for example, only $7\frac{1}{2}$ square inches out of 32 square feet (4,608 square inches) in a preferred embodiment of the invention, permits conduction of only a minor fraction of the amount of heat or cold from one side to the other of the panel. This is a much smaller amount than is conducted by wooden or metal strength members which extend from one skin the entire distance to the opposite skin.

In a preferred embodiment of the invention a pair of parallel plywood skin members are separated from one another by a distance greater than the width of a stud, joist, or rafter member of sufficient strength for the intended loading of the panel, with the strength members being located between the skins, spaced apart from one another along the panel and attached alternately to the opposite ones of the skins by both an adhesive and mechanical fasteners. A spacer member of foam plastic material of the appropriate size is fastened by an adhesive to each of the strength members and to the opposite skin member along substantially the entire face of the strength member. Along each of the outer marginal portions of the panel an edge stiffening frame which is a composite structural member, comprising a pair of parallel edge stiffening members made up of dimensional lumber, laminated wood, or metal attached by adhesives and mechanical fasteners (nails, staples, screws) to a dense foam edge gap spacer providing a total thickness to match the planned thickness of the panel and its plastic foamed core, is located between the skins, fastened to the skins by an adhesive and mechanical fasteners. A plurality of wooden bridge members normally of $\frac{3}{8}''$ plywood 2" to 3" wide and as long as the distance between panel skins, are fastened to the edge stiffening frame members at midlength and in locations near each end of the panel, maintaining the desired separation between the skin members during assembly of the panel and thereafter.

The edge stiffening members may be inset a short distance such as $\frac{3}{4}''$ along the margins of both skins of a panel along one edge, and located so as to extend a like distance beyond the skin members along an opposite edge of the panel to provide a tongue-and-groove type of interlocking joint between adjacent ones of the panels during erection of a structure. Alternatively, the skin members on opposite sides of a panel according to the invention may be offset laterally with respect to one another to provide a ship lap type of joint between adjacent ones of the panels according to the invention. Placing the frame component flush with edges of the panel faces provides a butt joint between adjacent panels. By insetting the frames ($1\frac{1}{2}''$ or more) from the edges of both panel skins and on both sides of the panel a space of 3" or more is created as the panels are joined. This space of 3" or more will accept an insulated spline which joins adjacent panels or the space may be filled with structural lumber to create a concealed post or beam for load support.

It is therefore a principal object of the present invention to provide an improved thermally insulating structural panel capable of providing thermal insulation values far greater than those of building walls and panels of normal 2"×4", 2"×6", 2"×8" or larger dimension lumber stud construction.

It is another important object of the present invention to provide a building panel which includes no substantial paths for conducting thermal energy from one side to the other side of the panel, and yet meets structural strength requirements.

A principal feature of the building panels of the present invention is that they include bridge members extending transversely between the opposite skin members to maintain skin member spacing during both construction and use of the building panels, which have structural strengthening members located between skin members and fixedly attached alternately to both of the skin members, with the opposite skin members also being interconnected by the adhesive strength of a rigid foamed-in-place plastic foam core.

It is an important feature that electrical conduit, outlet boxes and switch boxes may be installed within the panel during construction of the assembly and before placement of the plastic foam. The conduit and boxes being foamed in prevents the conduit and boxes from collecting condensate and channeling cold air into the building.

It is another important feature of the building panels of the present invention that they include bridge members connecting the marginal portions of the skin members surrounding openings for windows and doors.

It is an important advantage of the building panels of the present invention that they provide better thermal insulation than was previously available in a building panel of high volume and low weight and which has a required amount of structural strength and rigidity.

It is another important advantage of the present invention that it provides a building panel which is high in thermal insulative value, but which contains no open voids which could serve as chimneys in case of fire, harbor vermin within a building constructed of such building panels or promote thermal cycling in cavities.

A further advantage of the present invention is that it provides a building panel which, having no substantial wood or metal members extending through the panel, effectively reduces noise transmission and socalled "telephoning" of sound along nails and wood paths.

The invention also has the advantage of providing a building panel which is of itself an aadequate vapor barrier and does not require a separate interior vapor barrier and an exterior wind or water barrier.

Still another important advantage of the invention is that the incorporation of structural and thermally insulating frame or stud components act to prevent structural "creep" that may occur in foam sandwich panels having only a foam core and no stiffeners or studs as structural components.

The foregoing and other objectives, features, and advantages of the present invention will be more readily understood upon consideration of the following detailed description of the invention, taken in conjunction with the accompanying drawings.

BRIEF DESCRIPTION OF THE DRAWINGS

FIG. 6 is a top view of a shiplap joint between two adjacent panels according to the invention.

FIG. 7 is a top view of a detail of a wall constructed using panels according to the invention in a concealed post-and-beam type of frame construction.

FIG. 8 is a top view of a detail of a wall constructed of panels according to the invention, using a spline joint between adjacent panels.

DETAILED DESCRIPTION OF THE INVENTION

Referring now to FIGS. 1–4 of the drawings, a building panel 10 which is a preferred embodiment of the present invention includes a pair of opposite skin members 12, 14 which are of material such as plywood. Alternatively, one or both of the skin members 12, 14 may be of a board constructed of wood chips adhesively integrated into panel form, or, depending upon the loading and atmospheric conditions to which the panel 10 is to be subjected, a gypsup wallboard.

Figure 1:
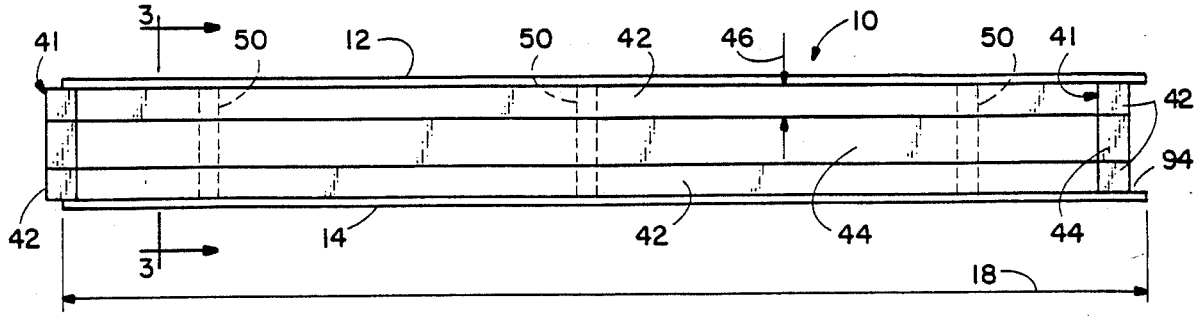
FIG. 1 is a side view of a wall panel constructed in accordance with the present invention.
Figure 2:
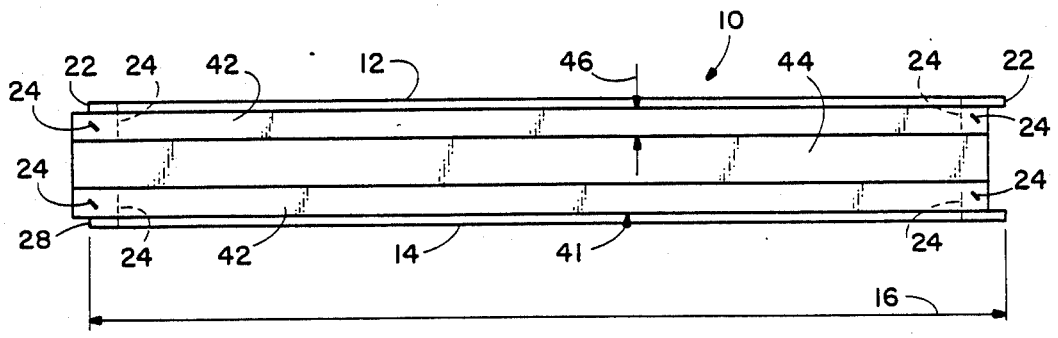
FIG. 2 is an end view of the wall panel shown in FIG. 1.

By way of illustration, the panel 10 shown in FIGS. 1 and 2 has skin members 12, 14 of $\frac{3}{4}$ inch thick exterior grade plywood, and has a width 16 of 4 feet and a length 18 of 8 feet. Other dimensions might be used, depending upon the intended use of the panel 10 according to the present invention, which has ample structural strength to be used to construct a self-supporting shell of a building, utilizing the panels 10 including appropriate components, depending upon the strength required, for floor, wall, and roof panels.

Attached fixedly to the skin member 12 are a pair of stiffening strength members 20 separated by a distance of approximately two feet, center-to-center, and extending parallel with one another, lengthwise of the panel 10. Each of the strength members 20 is located approximately one foot from the nearer of the longitudinal edges 22 of the skin member 12. The strength members 20 are attached to the skin member 12 by an adhesive, which may be any appropriately waterproof adhesive having sufficient strength, and by a plurality of mechanical fasteners such as staples 24 extending through the skin member 12 into the respective strength member 20.

A stiffening strength member 26 is attached similarly to the skin member 14 at a location midway between the strength members 20, approximately two feet from each of the longitudinal edges 28 of the skin member 14. Each of the stiffening or strength members 20 and 26 may, in the panel 10, be of nominal 2″×4″ dimension lumber, for example, thus having a thickness or smallest dimension 30 of $1\frac{1}{2}$″, and a major transverse dimension or depth 32 of $3\frac{1}{2}$″ in the direction toward the opposite one of the skin members 12, 14. Strength members 20, 26 may be of other sizes, depending on the loading to which the panel 10 will be subjected. The interior sides of the skin members 12, 14 are separated from one another by a distance 34 of, for example, $5\frac{1}{2}$″, leaving each of the strength members 20, 24 separated from the opposite one of the skin members 12, 14 by a gap space which is filled by a respective filler block 36, which is preferably of a high density, rigid polyurethane plastic foam material cut to the appropriate size and shape. Each filler block 36 is attached by a suitable adhesive to the respective one of the strength members 20, 26. While one dimension of the filler block 36 will be determined by the distance 34 between the skin members 12, 14, the width 38 of each is preferably equal to the thickness 30 of the respective strength member 20 or 26 to which the particular filler block is attached.

Extending along each of the longitudinal edges 22, 28 of the panel 10 are a pair of edge stiffener frame members 40. Each edge stiffener frame member 40 is constructed of two nominal 2″×2″ (actual dimensions $1\frac{1}{2}$″×$1\frac{1}{2}$″) wooden or lumber stiffeners 42 and one dense foam gap filler block member 44 ($2\frac{1}{2}$″×$1\frac{1}{2}$″) and three plywood bridge members 50. A similar edge stiffener frame member 41 extends along each end of the panel 10, as shown in FIG. 2. Depending upon the distance 34 separating the opposite skin members 12, 14 of a particular panel 10, and also depending upon the structural requirements for strength of the panel 10, the dimensions of the edge stiffener members 42 may be equal to those of the stiffening strength members 20, 26 in some cases, although in most cases the depth 46 of each edge stiffener 42 will be less than the depth 32 of the strength members 20 and 26, in order to assure that there is a significant distance separating the opposite edge stiffeners 42 as a barrier to conduction of thermal energy through the panel 10 from one side to the other.

As are the strength members 20, 26, each of the edge stiffeners 42 is attached to the respective skin member 12 or 14 by an appropriate adhesive and fasteners such as staples 24.

Any of the structural strengthening members 20, 26 or the edge stiffeners 42 may be of dimension lumber. Where additional strength requirements are present, these members may instead be of glued parallelgrain, laminated wood construction. In other cases a column member of several 2″×6″ members glued and nailed together might be fastened to the interior side of one of the skin members 12, 14 which will be the interior side of a panel 20 included in an exterior wall of a structure.

Figure 4:
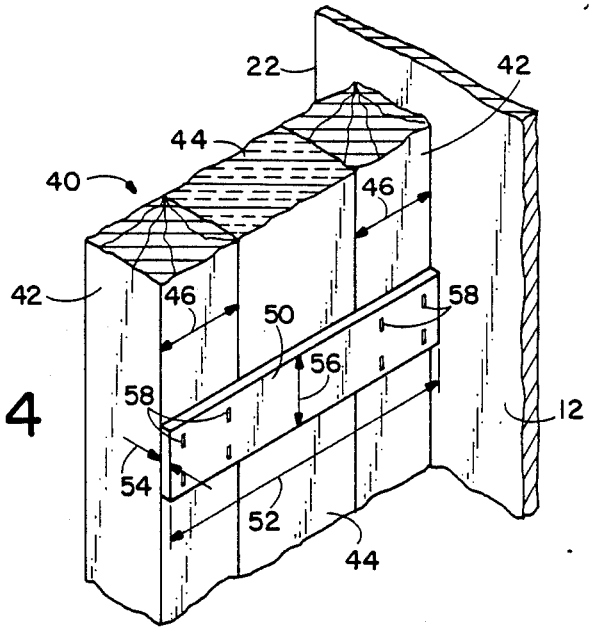
FIG. 4 is a detail view showing the manner in which one of the bridge members is included in the panel shown in FIGS. 1–3.

Extending between the interior surfaces of the skin members 12, 14 are a plurality of wooden bridge members 50, shown in greater detail in FIG. 4. The bridge members 50 each have a length 52 substantially equal to the distance 34 separating the skin members 12, 14. A thickness 54 is preferably $\frac{3}{8}$″, and, at most, need not be greater than the thickness 30 of the strength members 20, 26. A depth 56 of each bridge member 50 is, for example, about 2″, but in no case need the depth 56 be greater than the depth 32 of the strength members 20, 26.

The bridge members 50 are located spaced apart from one another along each of the longitudinal sides of the panel 10, as shown in FIG. 1, with, for example, three of the bridge members being located on each side of a panel 10. Each of the bridge members 50 is located adjacent to and attached to respective coplanar portions of opposite ones of the edge stiffeners 42, by mechanical fasteners such as the staples 58 shown in FIG. 4, which may be inserted using an automatic stapler.

As will be appreciated, the combination of the stiffening strength members 20, 26 and edge stiffeners 42, together with the respective filler blocks 36 and edge gap filler blocks 44, define a plurality of cavities 62, 64, 66, 68 between the opposite skin members 12, 14.

Each of these cavities is filled with a polyurethane or polyisocyanurate foam 70 which is placed in the respective cavities by injecting the necessary mixture of chemical reagents into the cavities 62, 64, 66, and 68, where they react forming a foam core having a density of at least about two pounds per cubic foot, and preferably about 2.5 to 2.75 pounds per cubic foot. A satisfactory material for this application is available from the CPR Division of the Upjohn Company as its CPR® 870 Class I pour or froth polyurethane foam system, which provides a foam having a shear strength of 21 psi perpendicular to the direction of rise of the foam and a compressive strength of as much as 38 psi depending on the direction of stress with respect to the rise of the foam.

Additionally, the foam 70 adheres itself strongly to the surrounding surfaces of the skin members 12 and 14, filler blocks 36, edge gap filler blocks 44, strength members 20, 26, edge stiffeners 40, and bridge members 50. As a result, the panel 10 is a strongly unified and structurally integrated panel in which the skin members 12 and 14, as well as the strength members 20, 26 and edge stiffener frame members 40, 41 all contribute to the overall strength of the panel 10 and its ability to carry the loads imposed by wind pressure, floor and roof loading, and the weight of structure supported above.

Depending upon the intended use of a particular panel in a wall, roof, or floor portion of a building to be constructed of the panels 10 according to the present invention, the actual dimensions of the components of the panel 10 may differ, in order to satisfactorily carry the expected weights and direction of application of loading, and to provide the required amounts of insulation, depending upon the expected exposure of the particular panel in its designed location in a structure. While the panels 10 have been shown having skin members 12 and 14 which are parallel with one another, it may be desirable in some cases for the skin members not to be parallel, depending on the location of a panel within a structure. Nevertheless, the structure of the panels 10 will remain essentially the same, in that the skin members, core, and strength members are unified by adhesive interconnection and the use of bridge members 50.

Figure 3:
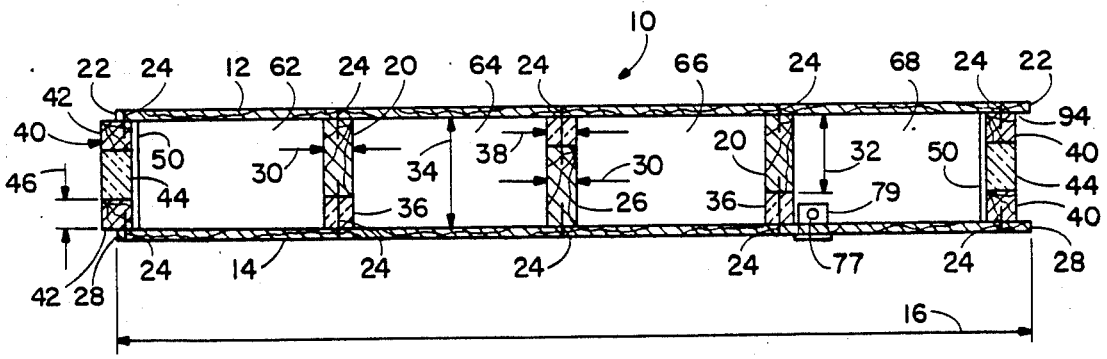
FIG. 3 is a sectional view of the panel shown in FIG. 1, taken along line 3—3.

If desired, an electrical conduit 77 and junction box 79 are provided within the panel, as shown in FIG. 3.

The panel 10 according to the present invention is manufactured by first assembling each of the longitudinal interior strengthening members and assembling edge stiffener frame members 40 and 41. Adhesives are applied on the two opposite $1\frac{1}{2}''$ dimension sides of the foam gap filler block member 44, which is then placed between the two wooden stiffeners 42. The frame member 40 is then placed in a jig set for the depth 46 of the edge stiffener frame member, in this case $5\frac{1}{2}''$.

Three bridge members 50 are fastened as by staples 24 to each ($1\frac{1}{2}''\times1\frac{1}{2}''$) wooden stiffener 42 which is approximately 8 feet long. One bridge member is placed in the middle of the approximately 8-foot dimension and another is placed about 8" in from each end, thus forming one insulating edge stiffener frame structural member 40. A total of two 8-foot edge stiffener frame members 40 and two approximately 4-foot-long members 41 make up the edge frames needed for one 4-foot ×8-foot panel 10. Bridge members 50 are not required for the approximately 4-foot-long end frame members 41.

Intermediate longitudinal members are made up of one nominal 2"×4" (actually $1\frac{1}{2}''\times3\frac{1}{2}''$) wooden structural strength member 20 or 26 and one ($1\frac{1}{2}''\times1\frac{1}{2}''$) dense foam filler block 36. Adhesives are applied to one $1\frac{1}{2}''$ side of the foam gap filler block 36, and it is placed against the $1\frac{1}{2}''$ edge of the 2"×4" 20 or 26; then the assembly is placed in the jig set for $5\frac{1}{2}''$ width. Staples 24 are driven through the foam edge of the filler block 36 into the 2"×4" 20 or 26 edge to hold the assembly together while the adhesive sets, thus forming one composite insulating interior longitudinal structural member. The edge stiffener frame members 40 and 41 and the composite interior longitudinal members are piled ready to be assembled into the completed panel 10 at the panel assembly tables.

A specially built panel assembly table is designed to assemble panels 10 up to 4 feet wide and 16 feet long. On the assembly table two 8-foot-long and two 4-foot-long frame members 40 and 41 are positioned on edge at the outer portion of the 4-foot width and the ends of the 8-foot length. Three interior longitudinal panel structural members are positioned on 12" centers in a configuration as shown in FIG. 3. Staples 24 are driven through the approximately 4-foot end frame members 41 into the ends of the five approximately 8-foot-long members 41, 20 and 26 at each end of the 8-foot-long members.

While the assembled frame setup is still in place on the assembly table, adhesives are applied to the top edges of the members 20, 26, 40, and 41. The plywood skin member 12 is then positioned on top of the already positioned members 20, 26, 40 and 41 and then staples 24 are set through the plywood skin into the wooden members 20 and 42. The positioning of the skin determines the type of joint the panel 10 being fabricated can form with adjacent panels.

Figure 5:
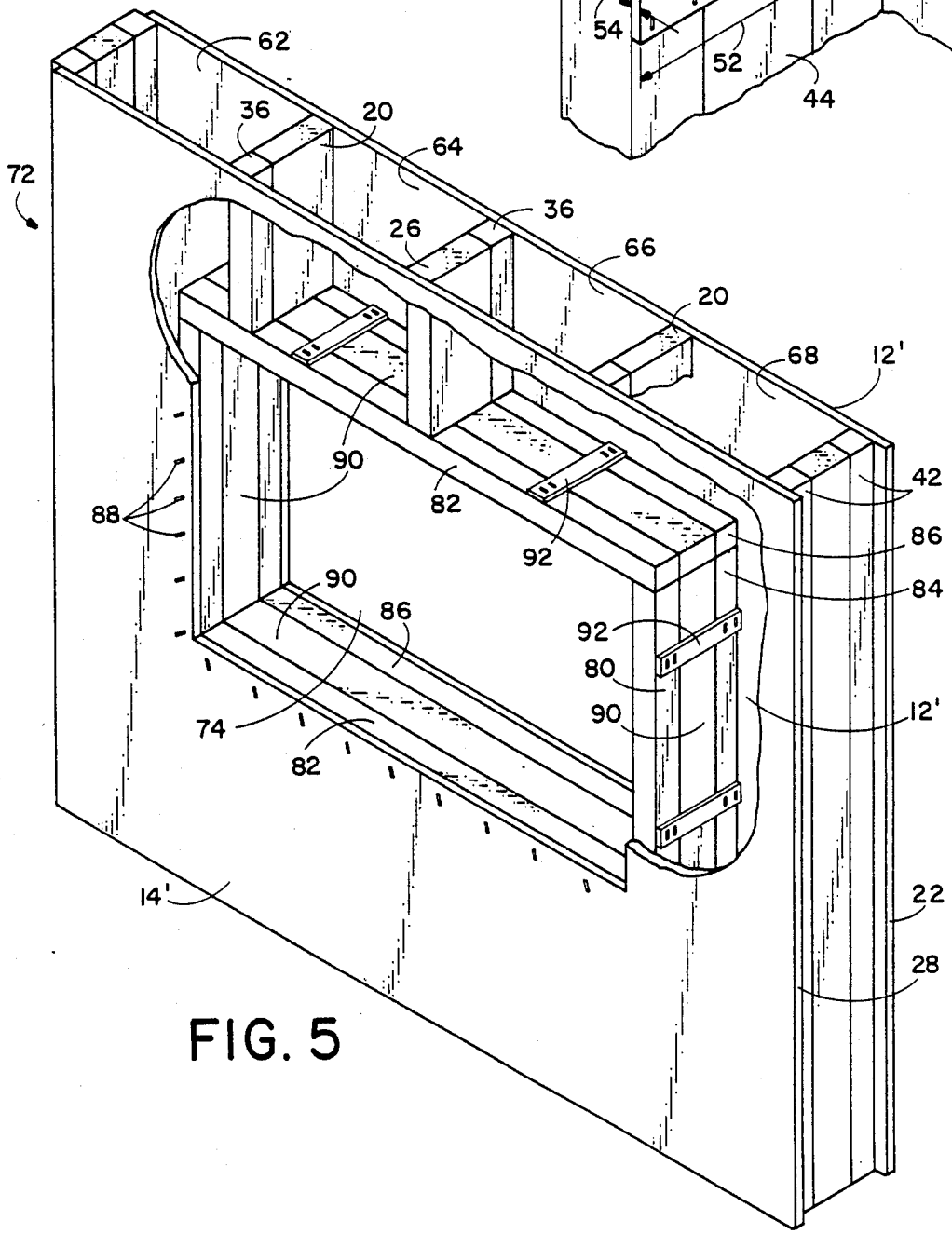
FIG. 5 a perspective view of another panel similar to that shown in FIGS. 1–4, but including a window opening through the panel.

At this phase of the assembly of the panel 10 the electrical wiring conduit 77 or raceways and the outlet boxes 79 may be installed. Also, door and window openings may be framed in (see FIG. 5), using frame members with bridge members 92 equivalent to the edge stiffener frame members 40, 41, included as needed.

The skin member 12 with the frames 16, 18, 20 now attached is taken from the first panel assembly table to a second panel assembly table and positioned with the skin member 12 face down with the attached frames 16, 18, and 20 showing upward. Adhesives are applied to the frame members and skin member 14 is placed in position and stapled 32 through the skin member 14 into the frames 16, 18, and 20, thus framing and skinning a panel 10.

The assembled panels 10 are taken from the table and placed flat on a strongback foaming cart. Separators of $1\frac{1}{8}''$ plywood are placed between adjacent panels 10, and the stack is taken to about a 6-foot height containing several panels 10. A strongback is placed on top of the stack and then fastened very securely to the bottom strongback to prevent bulging of the skins of panels 10 during foam placement.

Foam-forming chemicals are introduced in appropiate quantity into the several cavities 62, 64, 66, and 68 through openings made through the edge gap filler block 44 along an edge of an end edge stiffener frame member 41 of each panel 10. The chemicals then react within the panel cavities to form the insulating foam core 70 of the panels. During the foaming pressures of up to 3 pounds per square inch may occur. This pressure build-up acts to fill all of the cavities 62, 64, 66, and 68 and insures maximum adhesion of the foam to the skins and frame members within the cavities. The secured panel stack is kept restrained for about 30 to 45 minutes depending upon the foam core thickness and the temperatures in the foam room. Thereafter, the panel stack is broken down and the panels 10 are cleaned, checked and stacked for curing from 24 to 48 hours at room temperature before being subjected to outside weather.

It will be appreciated that this construction provides a panel 10 in which there are no members which extend as paths for conduction of heat from one side to the other of the panel, except for the relatively very small bridge members 50. These bridge members 50, however, serve a very important purpose in that they maintain the proper spacing between the skin members 12 and 14 both during and after construction of the panel 10. This helps to preserve the integrity of the panel along the longitudinal edges 22 and 28 and to prevent separation of the adhesive bond between the foam core materials 70 and the interior surfaces of the skin members 12, 14. The bridge members 50 also maintain the integrity of the panel 10 by connecting the edge stiffeners 40, 42, should separation occur between one of the skin members 12 or 14 and the foam materials 70, as, for example, might otherwise occur if the core 70 were ignited. Thus, the bridge members 50 strengthen the structure of a panel 10 whose skin members 12 and 14 are integral load-bearing members, rather than being simply weatherproofing covers, and in which none of the strengthening members 20, 26, or 42 form a path to conduct heat between opposite sides of the panel 10.

Referring now to FIG. 4, a panel 72 which also embodies the invention is essentially similar to the panel 10, except that it includes an opening 74 for a window, or door, which extends through the panel from a skin member 12' to the opposite skin member 14'. Except for the opening 74, the structure of the panel 72 is similar to that of the panel 10, and like parts are indicated in FIG. 4 by the reference numerals used previously in describing the panel shown in the panel 10. The panel 72 is shown without the expanded-in-place foam 70, in the interest of visibility: Surrounding the window opening 74 is a structural frame including edge stiffening members 80, 82, 84, 86 which are fastened to the skin members 12', 14' by adhesives and mechanical fasteners such as staples 88. Edge gap filler blocks 90 similar to the edge gap filler blocks 44 fill the space between the edge stiffeners 80, 82, 84 and 86. Bridge members 92, similar to the bridge members 50, are provided to perform the same functions around the margins of the opening 74 as the bridge members 50 described previously, and the framing around the opening 74 is assembled in the manner described above with respect to the edge stiffener frames 40 and 41.

Figure 9:
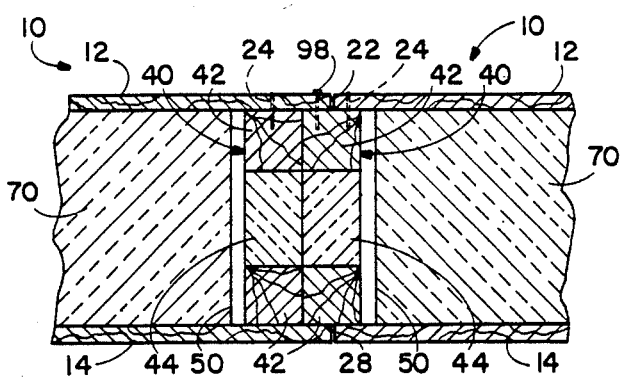
FIG. 9 is a view similar to that of FIG. 8, showing a tongue-and-groove joint between adjacent panels.

As shown in FIGS. 1–3, the skin members 12, 14 of a panel 10 intended to be used as part of a wall structure are located, with respect to the edge stiffener frames 40, so that at one side of the panel the skin members extend a slight distance beyond the edge stiffener frame 40, defining a space 94 between the extending portions of the skin members 12, 14, while at the opposite side of the panel, the edge stiffeners 42 extend beyond the respective longitudinal edges 22, 28 by a like distance, so that adjacent panels fit together in a tongue-and-groove manner as shown in FIG. 9, providing an inter-panel joint which is easily weatherproofed.

As shown in FIGS. 6 and 7, the locations of the edge stiffener frames 40, 41 with respect to the skins 12, 14 of a panel 10, may be varied, depending to some extent upon the application in which the particular panel 10 is to be used. Thus, as shown in FIG. 6, a pair of panels 10 are fastened to one another in a shiplap joint configuration in which the skin members 12, 14 are offset with respect to one another. At each side of each panel 10 one of the skin members 12, 14 exposes a portion of the respective edge stiffener 42 and extends beyond the other of the edge stiffeners 40, 42 a similar distance, preferably about one-half the thickness of the particular edge stiffener 42. Fasteners such as nails 98 may be used to join the panels 10 to each other.

In the pair of panels 10 shown in FIG. 7, the edge stiffener frames 40 are set inwardly from the edges 22, 28 a greater distance, corresponding to one-half of the width of a post 96 forming part of a post-and-beam frame of a structure, with the edges 22 and 28 of adjacent panels abutting against one another. Here, too, the bridge members 50 perform their function of maintaining the proper spacing between the opposite skin members 12, 14 of the panels, despite the forces which may be applied to the panels 10 by wind pressure or be transferred into the structural strength members 20, 26, and edge stiffeners 42 of the panels as a result of incorporation of the panels into a structure.

Figure 10:
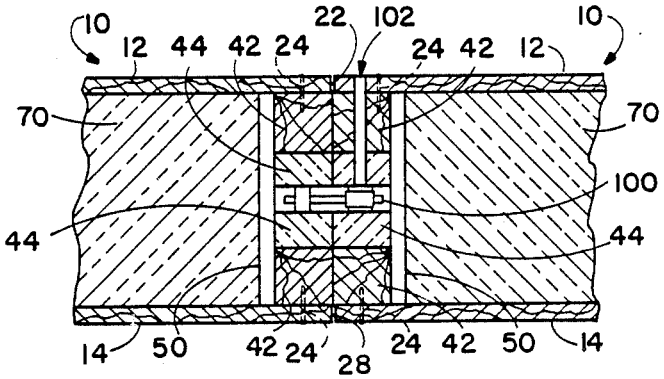
FIG. 10 is a view similar to that of FIG. 8, showing a butt joint between adjacent panels.
Figure 11:
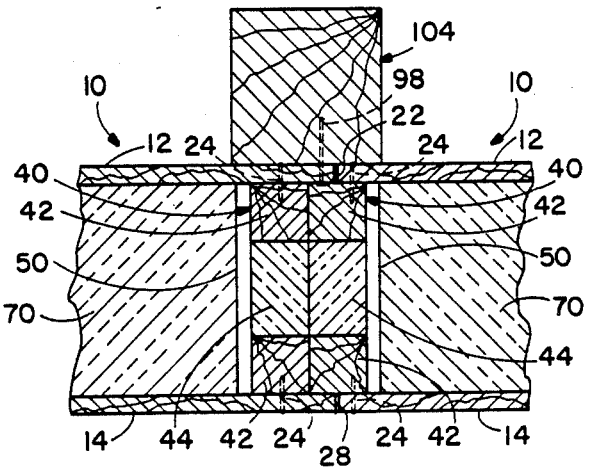
FIG. 11 is a view similar to that of FIG. 8, showing a tongue-and-groove joint between adjacent panels in a wall of exposed post construction.

The pair of panels 10 shown in FIG. 8 both have their edge stiffener frame members 40 set inward from the edges 22 and 28 of the skins 12, 14, and a spline member 97, similar to the edge stiffener frames 40 is located between the panels 10. Fasteners such as nails or staples 98 extend through the skin members 12, 14 into the spline member 97 to interconnect the panels 10. As shown in FIG. 10 a pair of panels 10 may have their edge stiffener frame members 40 flush with the edges 22, 28 of the skins 12, 14. The design of the insulated edge stiffener frame member 40 readily permits the use of mechanical locking cams 100, such as the cam manufactured by Kason and described in U.S. Letters Pat. No. 3,784,240, to join panels instead of nails. Such devices are used when buildings must be dismantled and used at other locations, with access to operate each cam 100 provided through a hole 102. FIG. 11 is similar to FIG. 9, and shows the use of fasteners such as nails 98 to fasten panels 10, joined together by a shiplap joint, to an exposed post 104.

The terms and expressions which have been employed in the foregoing specification are used therein as terms of description and not of limitation, and there is no intention in the use of such terms and expressions of excluding equivalents of the features shown an described or portions thereof, it being recognized that the scope of the invention is defined and limited only by the claims which follow.

What is claimed is:

1. A thermally insulating structural panel, comprising:

(a) a pair of oppositely located panel skins;

(b) a first plurality of wooden strength members located between said panel skins, each extending along and being adhesively connected to a first one of said panel skins, said strength members of said first plurality being oriented parallel with each other and being spaced apart along said first one of said panel skins;

(c) a second plurality of wooden strength members located between said panel skins, each extending along and being adhesively connected to a second one of said panel skins, said strength members of said second plurality being oriented parallel with each other and with the ones of said first plurality of strength members, and being spaced apart along said second one of said panel skins and located along said panel alternately with respect to said ones of said first plurality of wooden strength members;

(d) a respective filler block of rigid synthetic foam insulating material attached by an adhesive to each of said wooden strength members and to an opposite surface of the oppositely located one of said panel skins, substantially filling the available space between each of said strength members and the oppositely located one of said panel skins;

(e) a plurality of wooden edge stiffener members, each said edge stiffener member extending along a marginal portion of a respective one of said panel skins;

(f) a plurality of edge gap filler blocks of rigid synthetic foam material located between respective opposite ones of said edge stiffener members;

(g) a plurality of apart-spaced bridge member means extending perpendicularly between said panel skins and being attached fixedly to respective ones of said edge stiffener members for maintaining a predetermined distance between said panel skins; and (h) said strength members, said filler blocks, said edge gap filler blocks, and said panel skins defining a plurality of voids located between said panel skins, and a quantity of foamed-in-placed synthetic foam insulating material entirely filling each of said voids and adhesively interconnecting said panel skins, said strength memers, said edge stiffener members, and said filler blocks, so that said bridge member means and said foamed-in-place insulating material join said panel skins into a unified load-bearing structure in which loads are shared by said panel skins and said strength members, but wherein no wooden structural member other than said bridge member means extends from one of said panel skins to the other thereof.

2. The panel of claim 1 wherein said strength members are of dimension lumber having a thickness dimension and a greater depth dimension, each of said strength members being attached to the respective skin with said depth dimension extending toward the opposite skin.

3. The panel of claim 1 wherein said synthetic foam insulating material is a polyurethane foam.

4. The panel of claim 1 wherein said synthetic foam insulating material is a polyisocyanurate foam.

5. The panel of claim 1 wherein said synthetic foam insulating material has a density of about $2\frac{3}{4}$ pounds per cubic foot.

6. The panel of claim 1 wherein each of said skins is of plywood.

7. The panel of claim 1 wherein at least one of said skins is a sheet of adhesively bonded wood chip material.

8. A building panel for use as a loadbearing member of a structure, comprising:

(a) a pair of opposite skin members forming a pair of opposite sides of said panel and defining an interior space therebetween;

(b) a plurality of woden strength members each having a major transverse dimension oriented substantially normal to a respective one of said opposite sides, said strength members being arranged substantially parallel with each other and each of said strength members being attached fixedly to a respective one of said skin members, the ones of said strength members being attached fixedly to alternate ones of said pair of skin members and each strength member being spaced apart from the opposite one of said skin members within said interior space so as to define a respective gap space;

(c) a respective spacer member of a rigid foam plastic material being adhesively fastened to each said strength member and to the opposite skin member, each said spacer member filling the respective gap space and all of said strength members and said skin members jointly defining a plurality of interior cavities between adjacent ones of said strength members;

(d) a pair of wooden edge stiffeners located adjacent a margin of said panel, one of said pair of edge stiffeners being fixedly attached to each of said skin members and each of said edge stiffeners extending parallel to a respective edge of the respective skin and to the other one of said pair of edge stiffeners, said edge stiffeners of said pair being spaced apart from each other defining an edge gap space;

(e) an edge gap filler block of rigid foam insulating material attached adhesively to each of said edge stiffener members, filling said edge gap space therebetween; and (f) a plurality of bridge member means, spaced apart from one another and extending between said skin members of said panel within said interior space thereof and each of said bridge member means being mechanically fastened to both ones of a respective pair of said edge stiffeners, for maintaining a predetermined spacing between said skin members.

9. The building panel of claim 8 wherein the total sectional area of all of the bridge members is no greater than about $7\frac{1}{2}$ square inches.

10. The building panel of claim 8, including an opening defined therethrough having margins and further having edge stiffening frame members associated with said margins of said opening and including at least one of said bridge members associated with each edge stiffening frame member associated with said opening.

11. The panel of claim 8, further comprising an electrical utility circuit conduit and a junction box located therein.

12. The building panel of claim 8 wherein each of said bridge member means is a wooden member having a length equal to the distance between opposite interior surfaces of said skin members, a thickness no greater than the smallest dimension of each of said strength members, and a depth no greater than said major transverse dimension of said stiffening members.

13. The building panel of claim 12 wherein said bridge members are of plywood and are attached to respective ones of said edge stiffeners and strength members by driven mechanical fasteners.

* * * * *

UNITED STATES PATENT AND TRADEMARK OFFICE

CERTIFICATE OF CORRECTION

PATENT NO. : 4,671,032

DATED : June 9, 1987

INVENTOR(S) : William A. Reynolds

It is certified that error appears in the above-identified patent and that said Letters Patent is hereby corrected as shown below:

| | | | |
|---|---|---|---|
| Col. | 3, | Line 14 | Change "3/8" to --5/8--. |
| Col. | 4, | Line 50 | After "5" insert --is--; |
| | | Line 52 | After "opening" insert --extending--. |
| Col. | 5, | Line 12 | Change "gypsup" to --gypsum--; |
| | | Line 15 | Number "16" should be bold type; |
| | | Line 16 | Number "18" should be bold type; |
| | | Line 60 | After "to" delete the period. |
| Col. | 6, | Line 20 | Change "parallelgrain" to --parallel-grain--; |
| | | Line 31 | Change "3/8" to --5/8--. |
| Col. | 7, | Line 65 | Number "16" should not be bold type. |
| Col. | 10, | Line 31 | Change "an" to --and--. |
| Col. | 11, | Line 47 | Change "woden" to --wooden--. |

Signed and Sealed this

Fifth Day of January, 1988

*Attest:*

DONALD J. QUIGG

*Attesting Officer*

*Commissioner of Patents and Trademarks*